US007360651B2

(12) United States Patent
Kuo

(10) Patent No.: US 7,360,651 B2
(45) Date of Patent: Apr. 22, 2008

(54) DISPLAY DEVICE FOR DISPLAYING AN ADJUSTABLE SPANNER

(75) Inventor: Teng Hsien Kuo, Taipei Hsien (TW)

(73) Assignee: King Lugger Inc., Taishan Hsiang, Taipei Hsien (TW)

( * ) Notice: Subject to any disclaimer, the term of this patent is extended or adjusted under 35 U.S.C. 154(b) by 267 days.

(21) Appl. No.: 10/958,876

(22) Filed: Oct. 6, 2004

(65) Prior Publication Data

US 2006/0086636 A1 Apr. 27, 2006

(51) Int. Cl.
*B65D 85/28* (2006.01)

(52) U.S. Cl. ..... 206/376; 206/806

(58) Field of Classification Search ..... 206/376, 206/349, 373, 477, 377, 378; 211/70.6; 248/309.1, 248/110–113, 346.03, 346.04, 318
See application file for complete search history.

(56) References Cited

U.S. PATENT DOCUMENTS 6,375,005 B1 * 4/2002 McCann ..... 206/349
6,464,840 B1 * 10/2002 McCann ..... 206/376
6,719,154 B2 * 4/2004 Kao ..... 211/70.6
2005/0061757 A1 * 3/2005 Chiang ..... 211/70.6
2006/0091038 A1 * 5/2006 Hu ..... 206/495
2007/0007154 A1 * 1/2007 Wu ..... 206/349
2007/0007156 A1 * 1/2007 Wu ..... 206/376

* cited by examiner

*Primary Examiner*—Shian T. Luong

(57) ABSTRACT

A display device for displaying an adjustable spanner comprises a display panel having at least one ratchet holes for receiving at least one polygonal cylinder; each polygonal cylinder serving for connecting a respective adjustable spanner; a cambered slot formed in the display panel; and a clip for clamping the adjustable spanner to a cambered slot so that the adjustable spanner moves along the ratchet hole with the ratchet hole being as a moving center. A description paper is adhered to the display panel. It is only necessary to move the adjustable spanner reciprocally, the polygonal cylinder can be tightened or released so that the spanner clamping the polygonal cylinder can be tested by buyers before buying the spanner.

10 Claims, 11 Drawing Sheets

DISPLAY DEVICE FOR DISPLAYING AN ADJUSTABLE SPANNER

FIELD OF THE INVENTION

The present invention relates to display panels, and particularly to a display device for displaying an adjustable spanner, wherein it is only necessary to move the adjustable spanner reciprocally, the polygonal cylinder can be tightened or released so that the spanner clamping the polygonal cylinder can be tested by buyers before buying the spanner.

BACKGROUND OF THE INVENTION

With reference to FIG. 2, a prior art way for display an adjustable spanner is illustrated. In the prior art, an adjustable spanner T10 is placed upon a bottom plate T40. An upper cover T30 serves to cover the adjustable spanner upon the bottom plate 40. The descriptions T41 are printed on the bottom plate 40. However the prior art is not beneficial for the buyer as the buyer desires to rotate The above mentioned prior art way is a static way for displaying the adjustable spanner to buyers. Thereby there is improvement which desired to overcome the defect in the portion. With reference to FIG. 1, a prior art adjustable spanner is illustrated. In the prior art the adjustable spanner T10 can be operated reciprocally without needing to take the adjustable spanner T10 from the panel. When the adjustable spanner applies a force to a polygonal cylinder. It is only necessary to lift the clamp block T11 and movable block T12 so that the two blocks slide along the polygonal cylinder. The user further lifts the handle. Then the polygonal cylinder can be released or tightened by the reciprocal operation of the adjustable spanner.

However the prior art is used to displayed the adjustable spanner by applying the spanner to an object T20 having polygonal cylinder T21 which is desired to be screwed, but no indication is presented to buyers. Furthermore, the operation of the portion is inconvenient.

SUMMARY OF THE INVENTION

Accordingly, the primary object of the present invention is to provide a display device for displaying an adjustable spanner, wherein it is only necessary to move the adjustable spanner reciprocally, the polygonal cylinder can be tightened or released so that the spanner clamping the polygonal cylinder can be tested by buyers before buying the spanner.

To achieve above objects, the present invention provides a display device for displaying an adjustable spanner which comprises a display panel having at least one ratchet holes for receiving at least one polygonal cylinder; each polygonal cylinder serving for connecting a respective adjustable spanner; a cambered slot formed in the display panel; and a clip for clamping the adjustable spanner to a cambered slot so that the adjustable spanner moves along the ratchet hole with the ratchet hole being as a moving center. A description paper is adhered to the display panel. It is only necessary to move the adjustable spanner 10 reciprocally, the hexagonal post can be tightened or released.

the ratchet hole guides the polygonal cylinder to move clockwise or countercloskwise.

4. The display device for displaying an adjustable spanner as claimed in claim 1, wherein one side of the polygonal cylinder is a hexagonal post for being clamped by the adjustable spanner.

5. The display device for displaying an adjustable spanner as claimed in claim 1, wherein one side of the polygonal cylinder is installed with a cover.

6. The display device for displaying an adjustable spanner as claimed in claim 1, wherein a suspending hole is formed on the display panel for suspending the display panel.

7. The display device for displaying an adjustable spanner as claimed in claim 1, wherein a description paper is adhered to the display panel.

8. The display device for displaying an adjustable spanner as claimed in claim 7, wherein two lateral sides of the ratchet hole are punched with respective triangular noses so that the paper is accurately adhered to the display panel.

9. The display device for displaying an adjustable spanner as claimed in claim 2, wherein the clip has a U shape; a front end of each of two sides of the clip is a round post; each of two ends of the strip buckle is a respective recess; the round post passes through the cambered slot and then is buckled into a respective one of the recess.

Moreover, the clip has the shape and two tips of the clip are cambered so that the clip can slide along the slot easily. The cover is made of transparent material. Each of two lateral sides of the paper has a respective triangular label positioned corresponding to the triangular noses of the ratchet hole.

Furthermore, the paper has a hole, a diameter of the hole is slightly larger than that of the ratchet hole. The lower section of the paper is formed with a cambered slit; the size of the cambered slit is larger than the cambered slot of the display panel.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
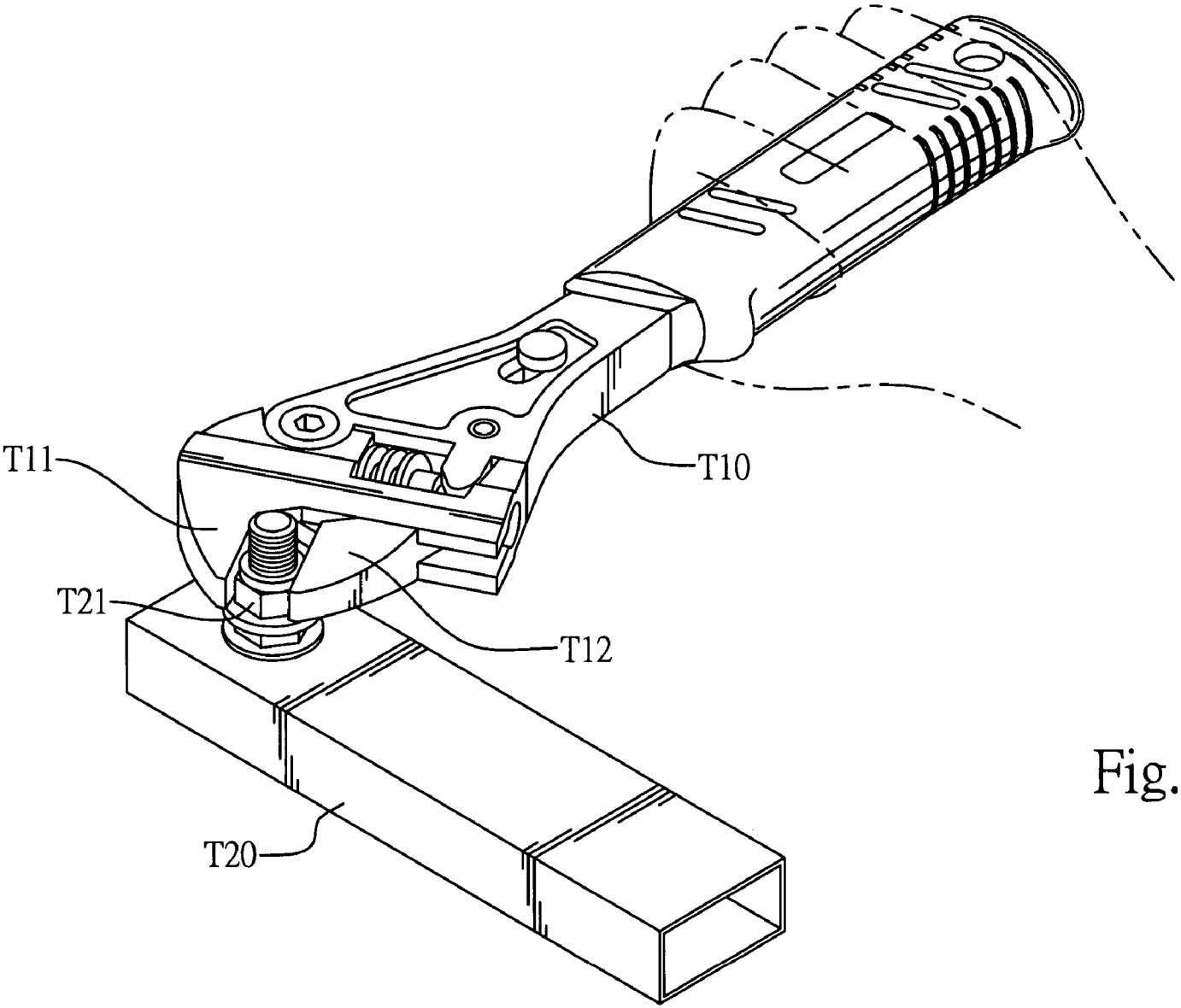
FIG. 1 shows an example of the prior art.
Figure 2:
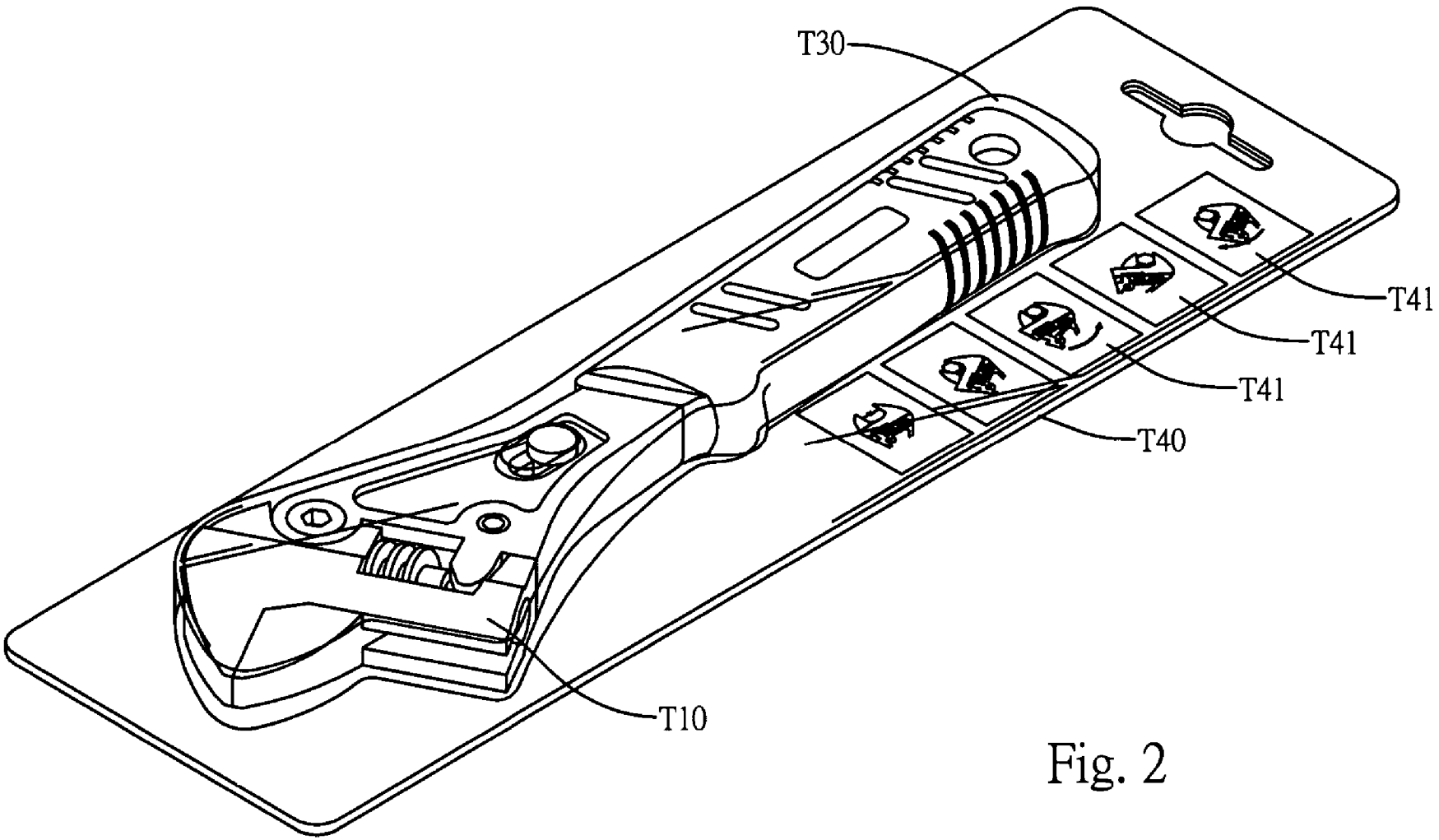
FIG. 2 shows another example of the prior art.
Figure 3:
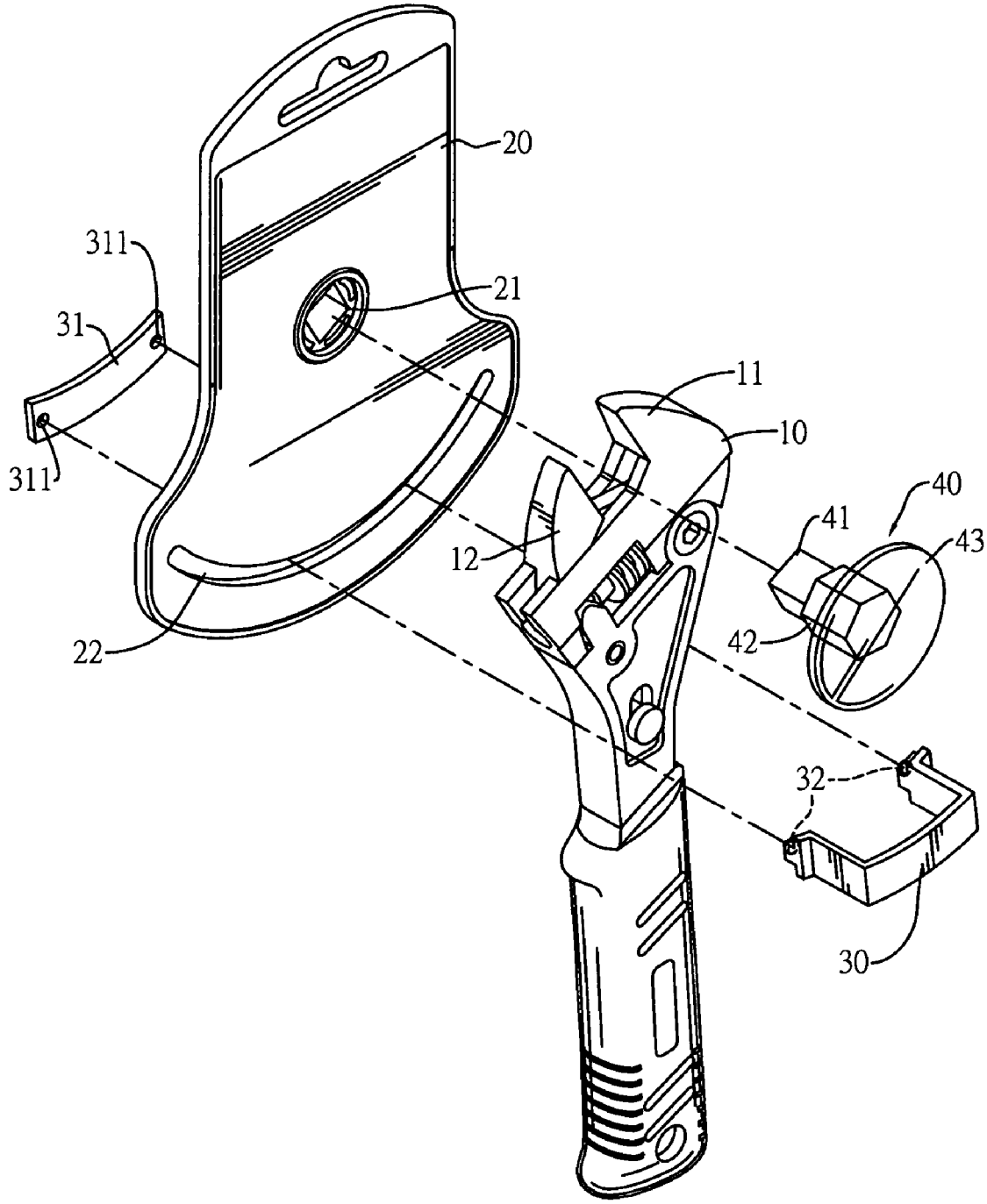
FIG. 3 is an exploded perspective view of the present invention.

With reference to FIG. 3, the present invention is illustrated. The present invention has the following elements.

A display panel 20 has a plurality of unidirectional ratchet holes 21. A lower side of the display panel 20 has a cambered slot 22.

A polygonal cylinder 40 is includes. The shape of each ratchet hole 21 is corresponding to that of a protruding post 41 at a front end of a polygonal cylinder 40 so as to receive the cylinder 40. In this embodiment, one end of the cylinder 40 is a rectangular protruding post 41 and another end thereof is a hexagonal section 42 for receiving the clamping portions 11, 12 of an adjustable spanner 1. The cover 43 is connected to the hexagonal post 42 for retaining the adjustable spanner 10. A surface of the protruding post 41 can be coated with combining agent for fixing the polygonal cylinder 40 to the ratchet hole 21.

A clip 30 has a U shape. A front end of each of two sides of the clip 30 is a round post 32.

A strip buckle 31 is included. Each of two ends of the strip buckle 31 is a respective recess 311. The round post 32 passes through the cambered slot 22 and then is buckled into a respective one of the recess 311. By high frequency technology, the clip 30 is firmly secured to the strip buckle 31. The clip 30 of U shape can be bent slightly to has an arc like that of the cambered slot 22 so that the clip 30 slides along the cambered slot 22.

Figure 4:
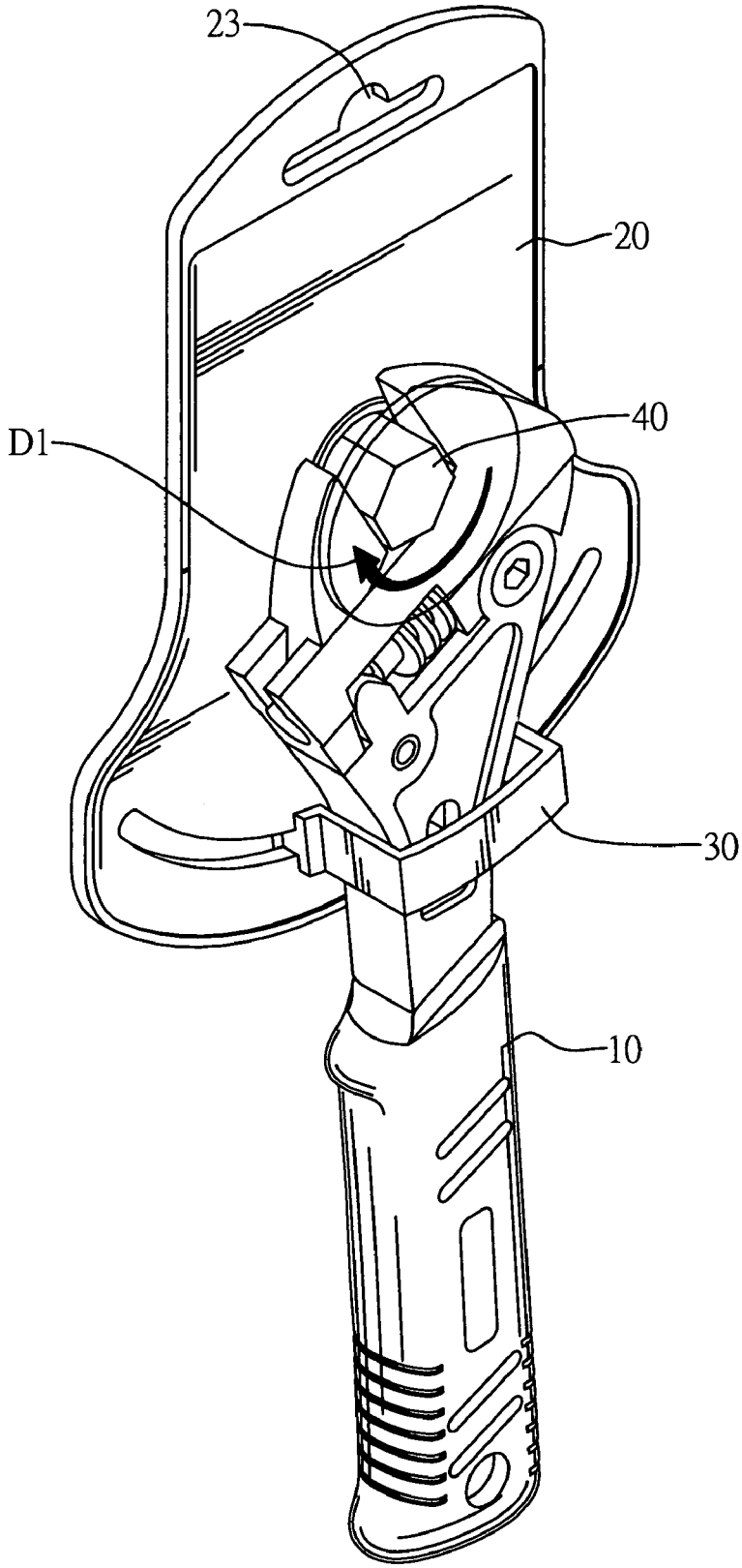
FIG. 4 is a schematic view showing one application of the present invention.

With reference to FIG. 4, a schematic view about the assembly of the present invention is illustrated. It is illustrated that the display panel 20 can be formed with a suspending hole 23 for suspending the display panel 20.

Figure 5:
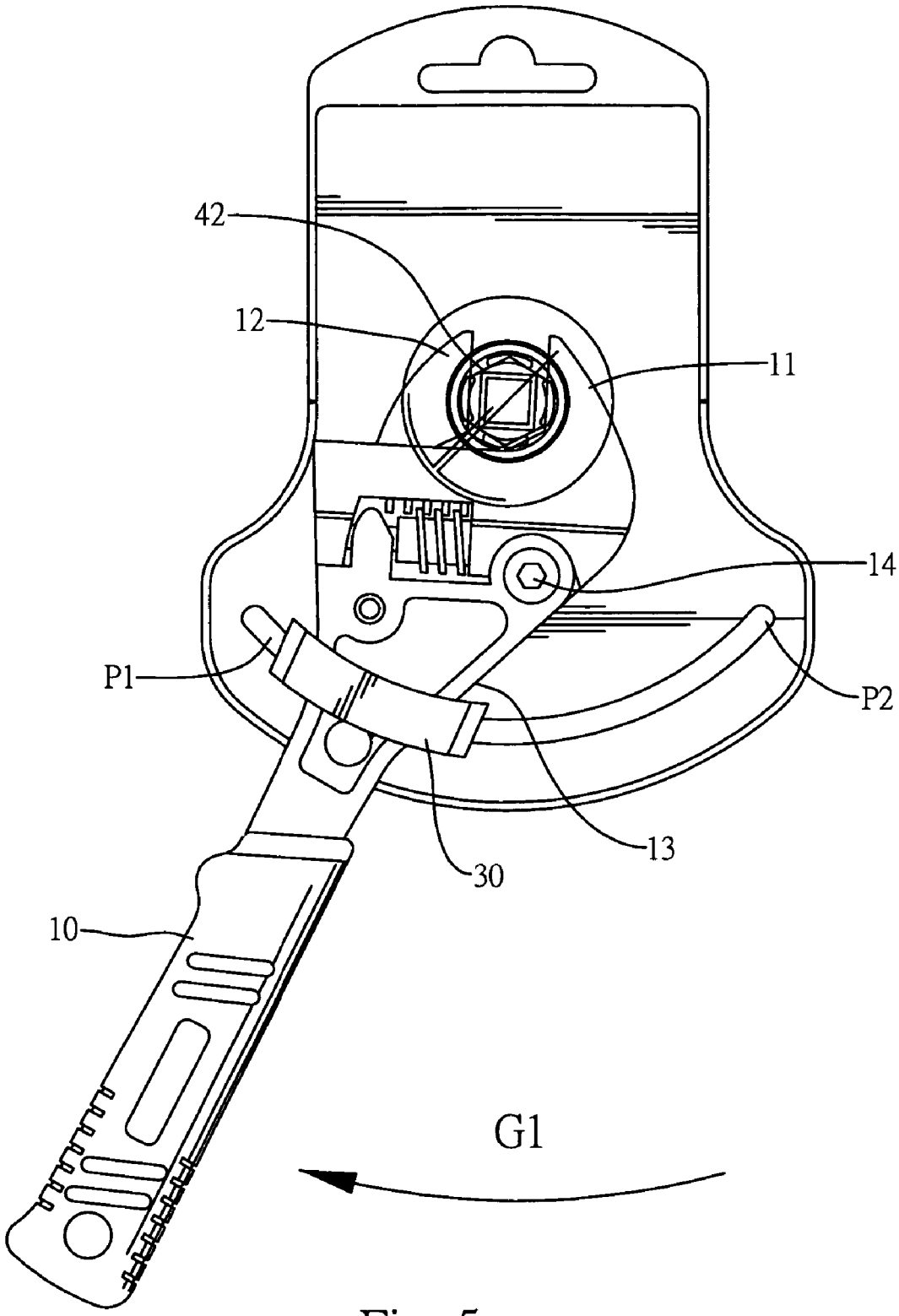
FIG. 5 is a schematic view showing the operation of the adjustable spanner according to the present invention.

With reference to FIG. 5, a schematic view showing the operation of the adjustable spanner 10, wherein the upper and lower clamping portions 11, 12 of the adjustable spanner 10 clamp the hexagonal post 42. The clip 30 clamps the adjustable spanner 10 at a neck portion 13 of the adjustable spanner 10. When a force is applied to the adjustable spanner 10 along a direction G, see FIG. 5, the adjustable spanner 10 will move from the position P1 to the position P2 so as to tight the hexagonal post 42.

Figure 6:
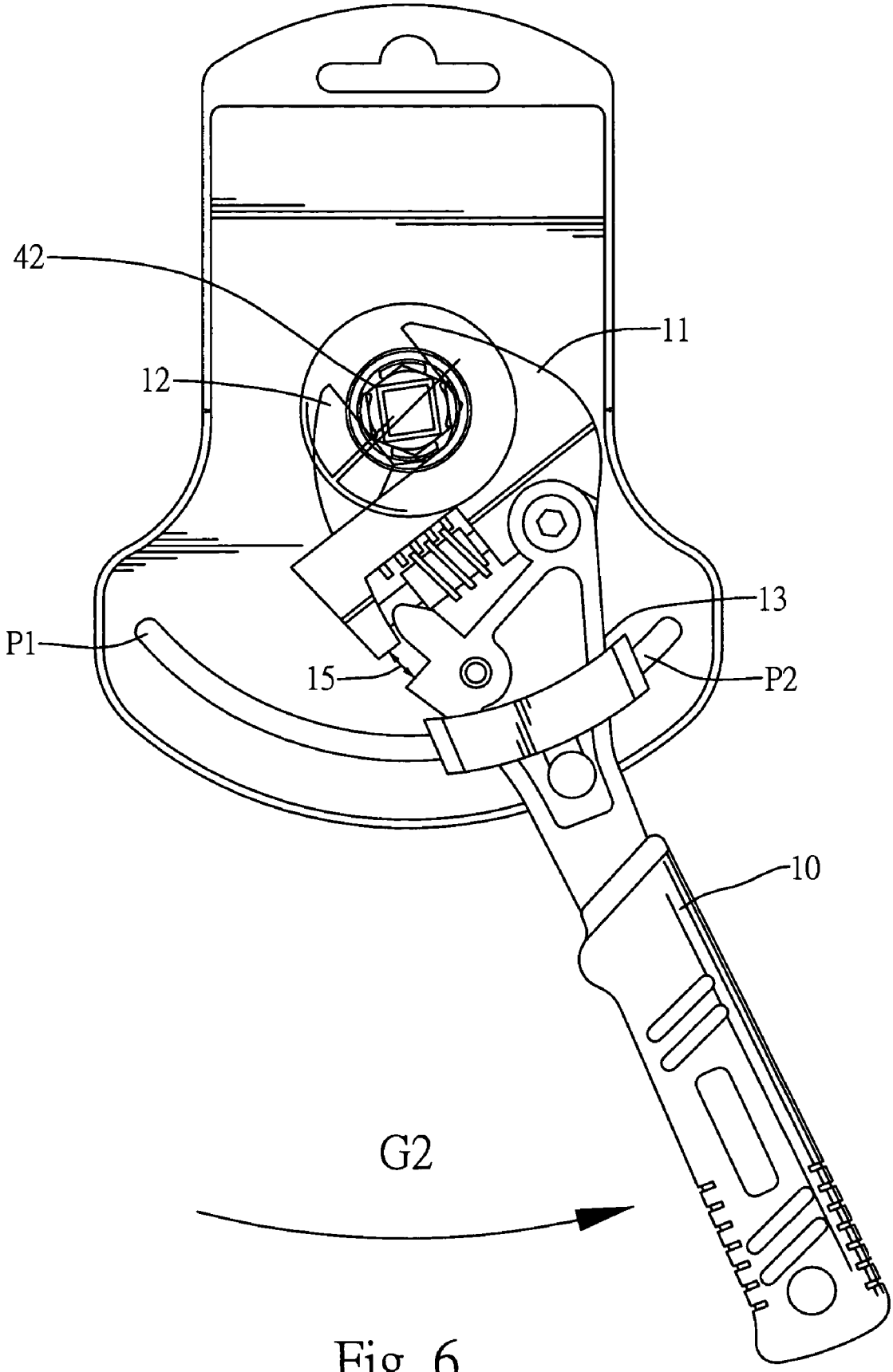
FIG. 6 is a schematic view showing another operation of the adjustable spanner according to the present invention.

With reference to FIGS. 4 and 6, since the polygonal cylinder 40 embedded into the unidirectional ratchet hole has an irreversible unidirectional clockwise rotating direction D1. A pivotal unit 14 is connected between the upper clamping portion 11 and the lower clamping portion 12. When a force is applied to the adjustable spanner 10 along a direction G2, see FIG. 6 (that is, the clip 30 moves from the first position P1 to the second position P2). The upper clamping portion 11 and the lower clamping portion 12 will expand to have a gap 15 so that the hexagonal post 42 can not be clamped. Namely, when the polygonal cylinder 40 on the display panel 20 is tightened or released, it is unnecessary to take the adjustable spanner 10 away from the display panel 20. It is only necessary to move the adjustable spanner 10 reciprocally, the hexagonal post 42 can be tightened or released. The cover 43 has a transparent material. The consumer can view the action of the display panel 20.

Figure 7A:
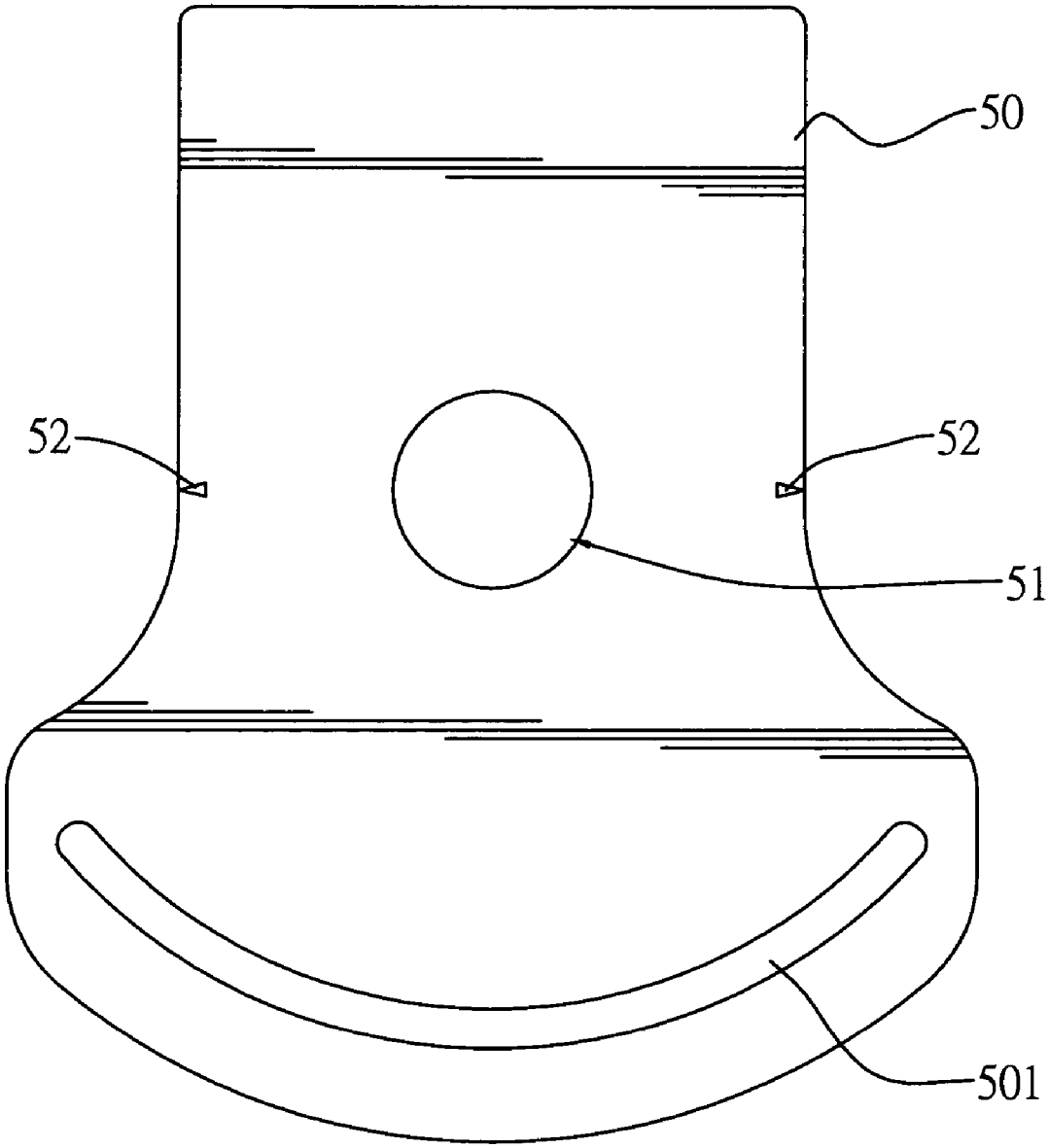
FIG. 7A is a schematic view showing the description used paper of the present invention.
Figure 7B:
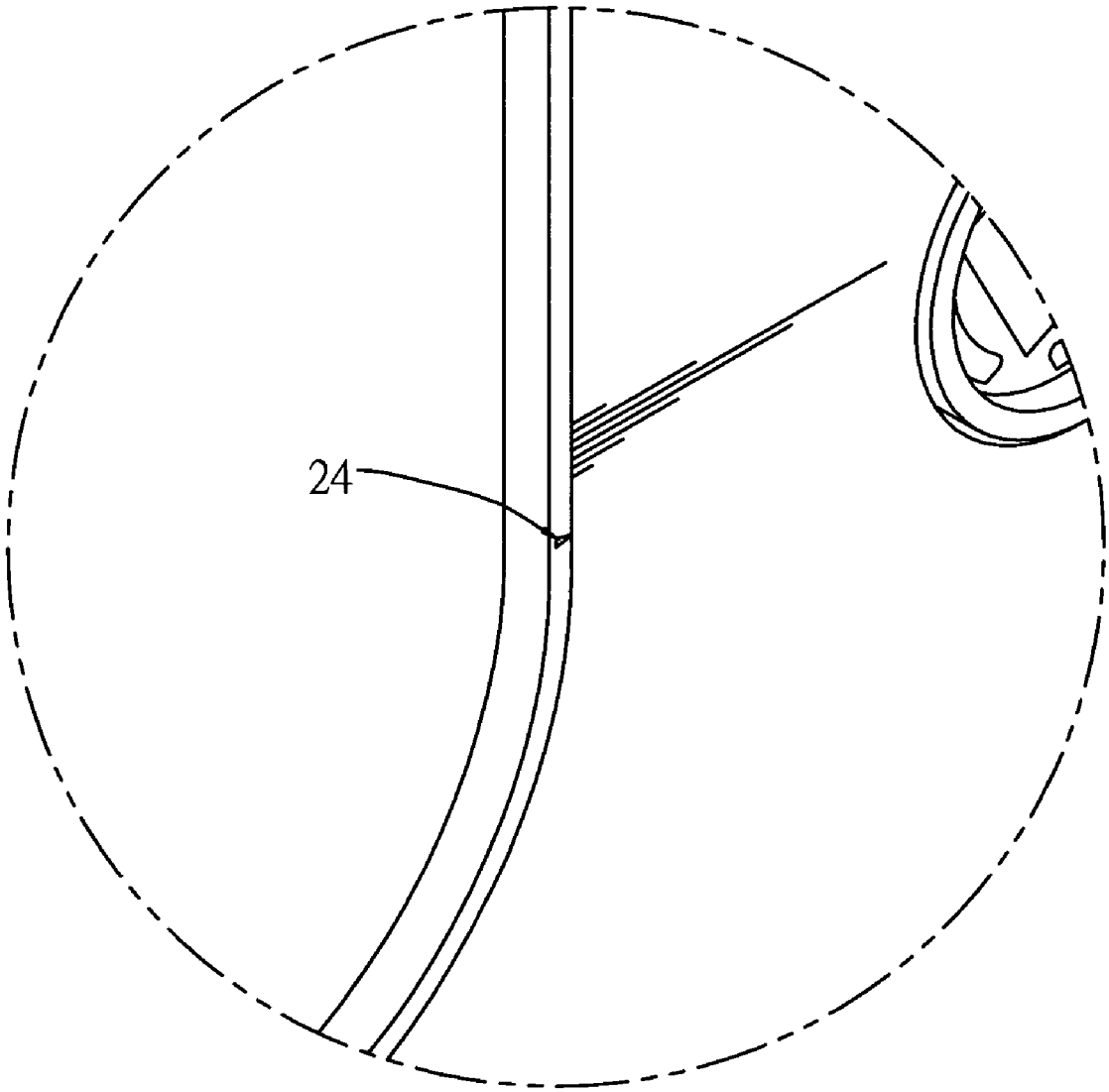
FIG. 7B is a partial enlarged view of the display panel of the present invention.

Referring to FIG. 7A, it is illustrated that the surface of the display panel 20 of the present invention can be adhered with a description used paper 50 for describing the function of the display panel 20. The shape and size of the paper 50 is matched to the space of the display panel 20. A hole 51 is formed on the paper 51. The size of the hole 51 is slightly larger than the diameter of the ratchet hole 21. A lower section of the paper 51 is formed with a cambered slit 501. The size of the cambered slit 501 is larger than the cambered slot 22 of the display panel 20. Each of two lateral sides of the paper 50 has a respective triangular label 52. Two lateral sides of the ratchet hole 21 are punched with respective triangular noses 24 so that the paper 50 can be accurately adhered to the display panel 20.

Figure 8:
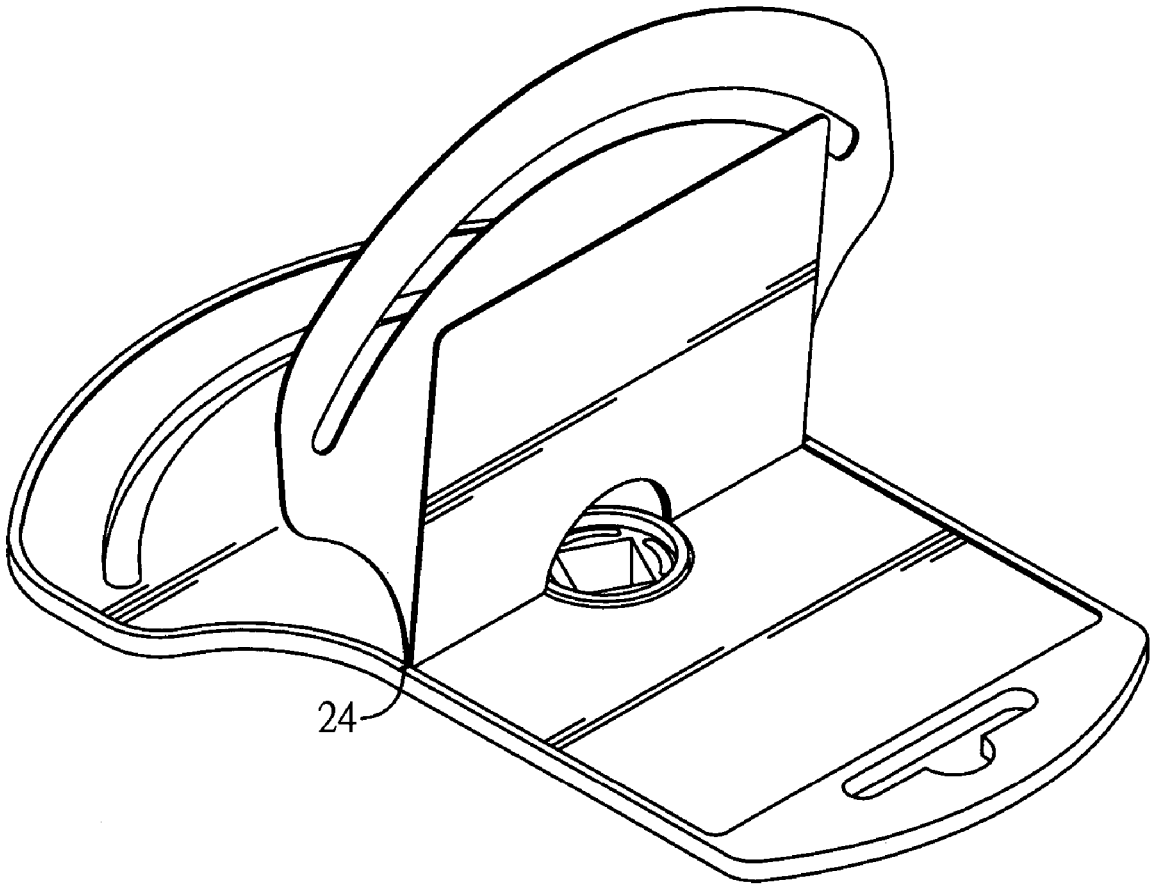
FIG. 8 is a schematic view showing that the paper is adhered to the display panel according to the present invention.
Figure 9:
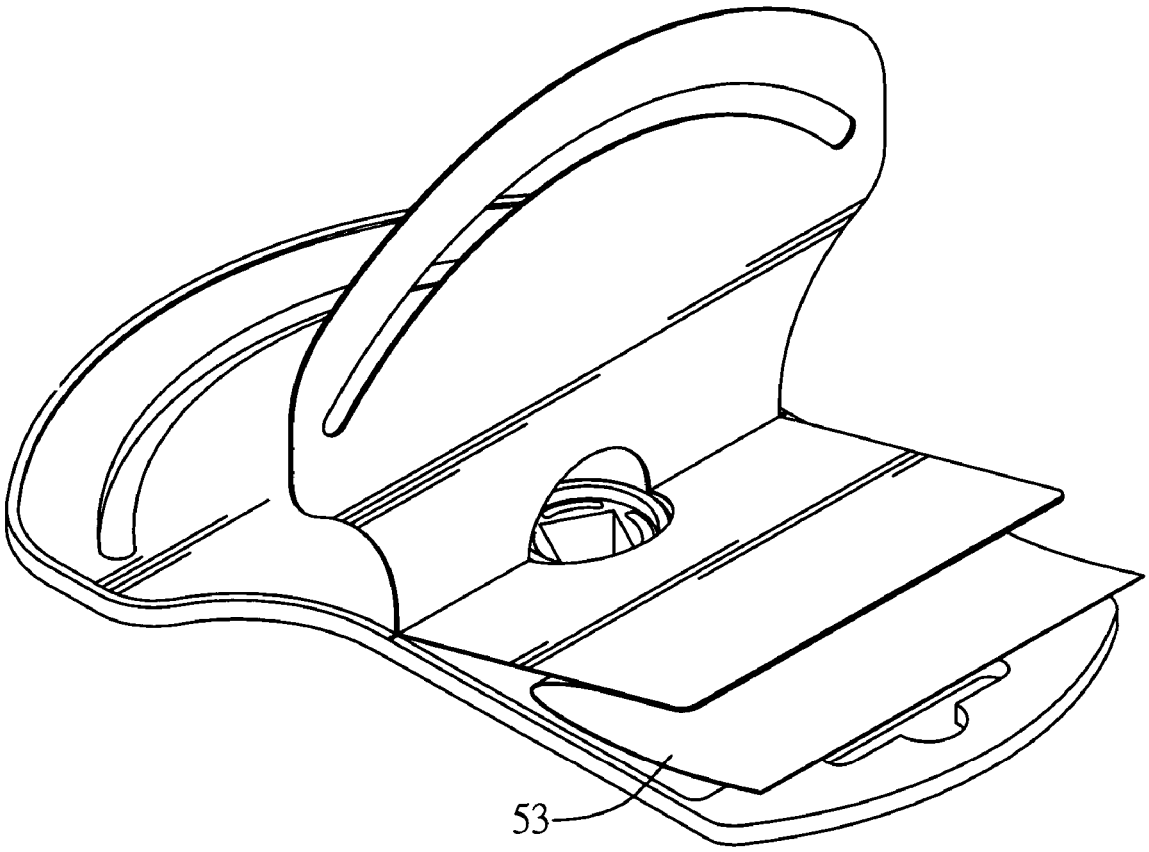
FIG. 9 is another schematic view showing that the paper is adhered to the display panel according to the present invention.
Figure 10:
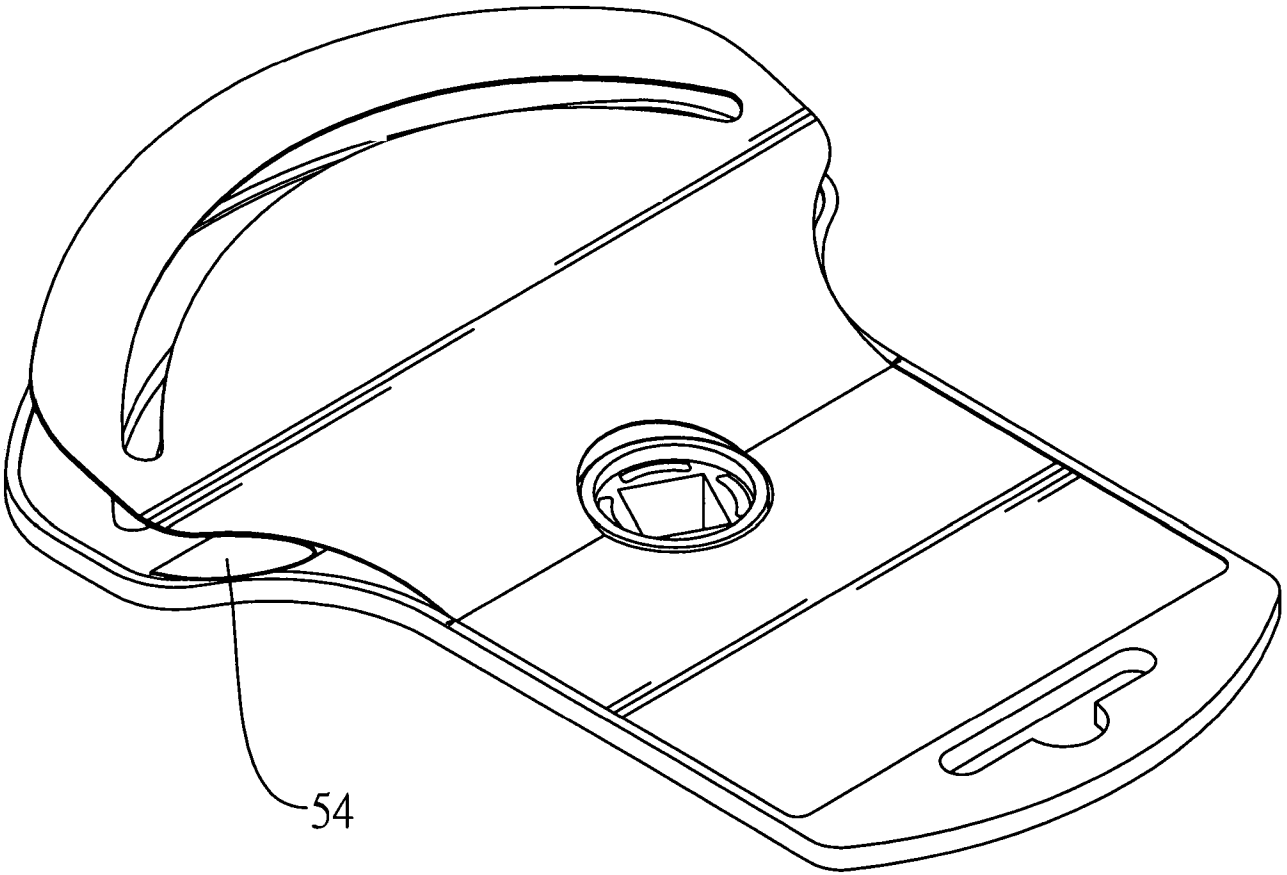
FIG. 10 is a further schematic view showing that the paper is adhered to the display panel of the present invention.

With reference to FIG. 8, a schematic view showing the adhesion of the paper 50. When adhering the paper 50, the triangular labels 52 of the paper 50 are aligned to the triangular noses 24 of the display panel 20. Then a protection film 53 at one side of the paper 50 is torn away, see FIG. 9. The protection firm 54 at another side of the paper 50 is also torn away, see FIG. 10.

Thereby the hole 51 of the paper 50 can complete align to the ratchet hole 21 of the display panel 20 with shiftness and the operation can be made easily.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A display device for displaying an adjustable spanner comprising:

a display panel having at least one ratchet hole for receiving at least one polygonal cylinder; each polygonal cylinder serving for connecting a respective adjustable spanner;

a cambered slot formed in the display panel; and a clip for clamping the adjustable spanner to said cambered slot so that the adjustable spanner moves along the ratchet hole with the ratchet hole being as a moving center;

wherein a description paper is adhered to the display panel; and wherein two sides of the display panel are punched with respective triangular noses so that the paper is accurately adhered to the display panel.

2. The display device for displaying an adjustable spanner as claimed in claim 1, further comprising a strip buckle which is combined to the clip so as to fix the clip.

3. The display device for displaying an adjustable spanner as claimed in claim 2, wherein the clip has a U shape; a front end of each of two sides of the clip is a round post; each of two ends of the strip buckle is a respective recess; the round post passes through the cambered slot and then is buckled into a respective one of the recess.

4. The display device for displaying an adjustable spanner as claimed in claim 1, wherein the ratchet hole guides the polygonal cylinder to move clockwise or countercloskwise.

5. The display device for displaying an adjustable spanner as claimed in claim 1, wherein one side of the polygonal cylinder is installed with a cover.

6. The display device for displaying an adjustable spanner as claimed in claim 5, wherein the cover is made of transparent material.

7. The display device for displaying an adjustable spanner as claimed in claim 1, wherein a suspending hole is formed on the display panel for suspending the display panel.

8. The display device for displaying an adjustable spanner as claimed in claim 1, wherein each of two lateral sides of the paper has a respective label positioned corresponding to the triangular noses of the ratchet hole.

9. The display device for displaying an adjustable spanner as claimed in claim 1, wherein the description paper has a hole, a diameter of the hole is slightly larger than that of the ratchet hole.

10. The display device for displaying an adjustable spanner as claimed in claim 1, wherein the lower section of the description paper is formed with a cambered slit; the size of the cambered slit is larger than the cambered slot of the display panel.

* * * * *